United States Patent [19]

Kurtz

[11] 4,445,975

[45] May 1, 1984

[54] HEADBOX FOR A PAPERMAKING MACHINE

[75] Inventor: Rüdiger Kurtz, Immenstaad, Fed. Rep. of Germany

[73] Assignee: Escher Wyss GmbH, Ravensburg, Fed. Rep. of Germany

[21] Appl. No.: 321,676

[22] Filed: Nov. 16, 1981

[30] Foreign Application Priority Data

Nov. 26, 1980 [CH] Switzerland ..... 8744/80

[51] Int. Cl.[3] ..... D21F 1/02

[52] U.S. Cl. ..... 162/336; 162/343; 162/344; 162/347

[58] Field of Search ..... 162/344, 347, 317, 343, 162/336

[56] References Cited

U.S. PATENT DOCUMENTS

| | | | |
|---|---|---|---|
| 2,203,802 | 6/1940 | Thaler | 162/344 |
| 2,418,600 | 4/1947 | Ostertag et al. | 162/344 |
| 2,473,270 | 6/1949 | Adams | 162/336 |
| 3,098,787 | 7/1963 | Sieber | 162/343 |
| 3,309,264 | 3/1967 | Parker et al. | 162/338 |
| 3,565,758 | 2/1971 | Higgins et al. | 162/336 |
| 3,976,539 | 8/1976 | Kirjavainen | 162/347 |
| 4,021,296 | 5/1977 | Reiner | 162/344 |
| 4,125,429 | 11/1978 | Hergert et al. | 162/347 |
| 4,141,789 | 2/1979 | Justus | 162/336 |
| 4,345,970 | 8/1982 | Radvan et al. | 162/344 |

*Primary Examiner*—Peter Chin

*Attorney, Agent, or Firm*—Werner W. Kleeman

[57] ABSTRACT

A headbox contains a nozzle channel which, in the direction of flow of the stock suspension or pulp. converges towards an outlet gap or slice. The nozzle channel contains two lips. At least one of these lips has a wall portion or section which is concave with respect to the stock suspension. This wall section is defined by imaginary curved reference lines. This wall section or portion is formed by steps or step portions extending essentially parallel to the outlet gap. Each of the step portions comprises a substantially planar partial surface extending comparable to the direction of flow of the stock suspension and an end surface disposed transversely with respect to its related planar or flat partial surface. At the region of this particularly simple to fabricate wall section there is thus produced microturbulence directly prior to the sheet formation. Such microturbulence ensures for a uniform formation of the stock fibers which are suspended at the region of the marginal flow or boundary region of the stock suspension.

7 Claims, 7 Drawing Figures

HEADBOX FOR A PAPERMAKING MACHINE

CROSS REFERENCE TO RELATED CASE:

This application is related to the commonly assigned, copending U.S. patent application Ser. No. 322,020 filed Nov. 16, 1981, entitled "HEADBOX FOR A PAPERMAKING MACHINE", and listing as the inventors Alfred Bubik, Hans Dahl and Rüdiger Kurtz.

BACKGROUND OF THE INVENTION

The present invention relates to a new and improved construction of a headbox for a papermaking machine.

Generally speaking, the headbox arranqement of the present development is of the type containinq an infeed channel for the stock suspension or pulp which is being processed. Merging with this infeed channel is a nozzle channel which converges in the direction of an outlet gap or slice. The nozzle channel is bounded by two lips or lip members. One of these lip members possesses at its inner surface at least one step portion extending transversely with respect to the primary flow direction of the stock suspension. This step portion is formed by an essentially flat or planar partial surface of the inner surface and an end surface disposed transversely with respect to the primary flow direction. This flat or planar partial surface extends in the lengthwise direction of the headbox in a manner corresponding essentially to the primary flow direction of the stock suspension.

In European Patent Application No. 0 015 670, filed Feb. 14, 1980 and the cognate U.S. Pat. No. 4,345,970 there is disclosed a prior art headbox arrangement of the aforementioned type. Here, the step portions are formed at the underside of an upper lip which is curved in a convex fashion with respect to the stock suspension. This upper lip or lip member extends from the top towards the bottom of the headbox arrangement. This upper lip is prolonged by a rigid lip portion which protrudes past the outlet gap. At the lower lip or lip member there is attached at the outlet gap a flexible, foil-like lip portion which bears by means of its free end upon a movable web of a sheet forming device. The rigid lip portion of the state-of-the-art equipment serves for guiding the flow of the stock suspension effluxing out of the nozzle channel.

SUMMARY OF THE INVENTION

Therefore, with the foregoing in mind it is a primary object of the present invention to provide a new and improved construction of a headbox for a papermaking machine which improves the guiding of the flow of the stock suspension within the nozzle channel and enables fabricating in a most simple manner the headbox such that, by virtue of turbulence of the stock fibers located at the region of the marginal flow of the stock suspension, there is effectively precluded the formation of otherwise formed turbulence threads or jets which arise at the region of concave wall portions.

Another important object of the present invention and in keeping with the immediately preceding object is to devise a new and improved construction of headbox which affords a uniform distribution of the stock suspension flowing towards the outlet gap or slice, and thus, provides for a substantially constant quality of the paper which is to be fabricated.

Yet a further significant object of the present invention is directed to a new and improved construction of headbox for a papermaking machine, which is relatively simple in construction and design, extremely economical to manufacture, highly reliable in operation, not readily subject to breakdown or malfunction, and requires a minimum of maintenance and servicing.

Now in order to implement these and still further objects of the invention, which will become more readily apparent as the description proceeds, the headbox of the present development is manifested by the features that the step portion is arranged at a section of the inner surface which is concave with respect to the stock suspension. This inner surface is defined by imaginary reference lines which extend in a curved fashion in the primary flow direction of the stock suspension, and at the region of such imaginary reference lines there is located a corner of the step portion.

By virtue of the inventive arrangement of the step portion there is produced microturbulence at the marginal flow of the stock suspension. By the action of this microturbulence there is annihilated the secondary flow at the region of the concave inner surface which is caused by the centrifugal force effective at the stock suspension. The secondary flow is formed by virtue of displacement of the boundary layer. Due to annihilation of the secondary flow there is precluded the formation of the so-called turbulence threads or jets which become perceivable in the form of, for instance, disturbing streaks or strips in the paper web which is to be fabricated.

According to a particularly advantageous construction of the invention the step portion can be arranqed between a guide device through which flows the stock suspension and a portion of the inner surface of the headbox which extends at least approximately parallel to a substantially band-shaped movable dewatering surface and also extends in the direction of the outlet qap. The guide device through which flows the stock suspension is located at an acute angle with respect to the band-shaped movable dewatering surface. This headbox construction is particularly suitable for secondary headboxes, by means of which the layer of the stock suspension which is to be formed is intended to be deposited upon one or more existing layers or plies.

According to a further advantageous construction of the headbox the step portion can merge upstream and downstream with a respective flat or planar portion of the inner surface of the headbox. In this manner the entire concave portion of the related inner surface of the lip member or lip can be replaced by a step or step portion or also a series of successive step or step portions, so that the entire inner surface is composed of flat or planar surface portions. Also, it is possible to thus dispense with the otherwise relatively complicated and cumbersome machining of a curved inner surface, which appreciably simplifies the fabrication of the lip or lip member.

To preclude any depositing of stock fibers at the corner of the step portion, namely the peripheral corner with respect to the curvature, the end surface of the step portion can be connected by a groove or fillet-like corner portion with the portion of the inner surface which merges at the periphery of the end surface.

In order to be able to infuence the flow behaviour within the nozzle channel and to facilitate the fine setting or adjustment of the outlet gap or slice, it is advantageous if at least one of the lip members is movably arranged with respect to the other lip member.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
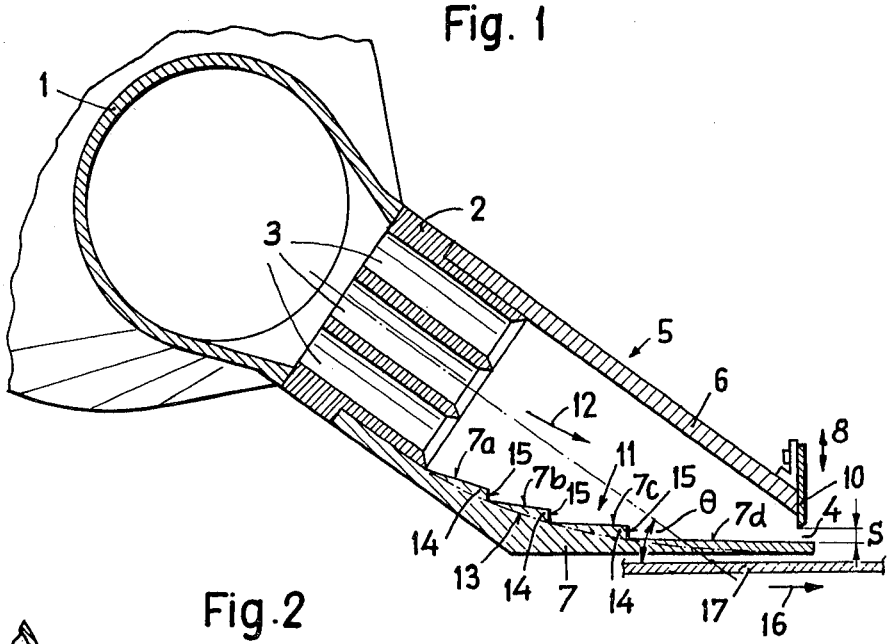
FIG. 1 illustrates in partial cross-sectional view a headbox constructed according to the invention.

Describing now the drawings, it is to be understood that only enough of the construction of the various embodiments of headboxes disclosed herein and useful for papermaking machines have been illustrated therein in order to enable those skilled in the art to readily understand the underlying principles and concepts of the present development while simplifying the showing of the drawings. Turning attention now to FIG. 1, the headbox construction depicted by way of example therein, will be seen to comprise a distributor line or manifold 1 or equivalent structure which is connected in any suitable and well known manner in this technology with a here not further illustrated infeed line for the stock suspension or pulp or the like which is being processed. Laterally merging with the manifold or distributor line 1 is a guide device 2 which, in the embodiment under discussion, is provided with cylindrical openings or channels 3. An appropriate construction of manifold or distributor line which can be used with the headbox of the present development, and which does not however constitute subject matter of this invention, has been disclosed, for instance, in the German Patent Publication No. 2,607,823 and the cognate U.S. Pat. No. 4,087,321, granted May 2, 1978.

The lengthwise axes of the openings or channels 3 of the guide device 2 are disposed at an acute angle $\Theta$ with respect to a substantially band-shaped dewatering surface 17 of a here not further illustrated sheet forming device of a papermaking machine. This band-shaped dewatering surface 17 is movable in the direction of the arrow 16 shown in FIG. 1. Merging with the guide device 2 is a nozzle channel 5 which converges towards an outlet gap or slice 4. This nozzle channel 5 is bounded by two rigid lips or lip members 6 and 7 which are attached to the guide device 2 in any appropriate fashion. The upper lip member or lip 6 shown in FIG. 1 will be seen to comprise a flat or planar inner surface which extends essentially parallel to the lengthwise axes of the openings or channels 3 of the guide device 2. This upper lip member 6 is provided at its tip or free end with a diaphragm 10 or equivalent closure element which can be selectively displaced in the direction of double-headed arrow 8 and fixed in the selected position in any appropriate fashion, so that there can be adjusted the width S of the outlet gap 4. The lower lip or lip member 7 shown in FIG. 1 will be seen to contain at its inner surface a section or portion 11 which is concave with respect to the stock suspension which is being processed. This concave wall portion or section 11 of the headbox is defined by curved reference lines 13 extending in the primary flow direction of the stock suspension as indicated by the arrow 12. This concave wall portion or section 11 transforms into a flat partial surface *7d* of the inner surface of the lip member 7. This flat or planar partial surface *7d* extends towards the outlet gap 4 and runs essentially parallel to the dewatering surface 17.

The concave wall portion or section 11 of the inner surface of the headbox or lip member 7 possesses, in the embodiment under discussion, three step portions or steps 14 which are located in succession with respect to the direction of flow of the stock suspension. These step portions or steps 14 are each formed by a respective flat or planar partial surface *7a, 7b* and *7c* of the inner surface of the lip member 7 and a related end surface 15 confrontinq the outlet gap 4 and extending essentially parallel to said outlet gap 4. The corners of the step portions 14, constituting peripheral portions with respect to the curvature and formed between the end surfaces or faces 15 and the partial surfaces *7b, 7c* and *7d* which merge with the related end surface 15 downstream thereof, are located at the region of the reference lines 13 (see for instance FIG. 2).

The partial surfaces *7a, 7b* and *7c* are each inclined in a flow downstream decreasing angle towards the partial surface *7d* and form with the oppositely situated portion of the inner surface of the lip member 6 a respective converging channel section.

With this embodiment an imaginary concave reference surface, defined by the reference lines 13, is replaced by the three successively arranged step portions 14 and the tip or front of the lip member 7.

During operation there is infed a stock suspension through the manifold or distributor line 1 to the headbox. This stock suspension is uniformly distributed by the openings or channels 3 of the guide device 2 throughout the width of the nozzle channel 5 measured perpendicular to the plane of the drawing of FIG. 1. At the region of the concave section or portion 11 stock suspension is deflected in a direction parallel to the dewatering surface 17 and is applied, through the outlet gap or slice 4, onto such dewatering surface 17.

During such time as the stock suspension flows through the nozzle channel 5 this stock suspension is continuously accelerated at the regions of the partial surfaces *7a, 7b, 7c* and *7d*. By virtue of the rigid construction of the lip members 6 and 7 the cross-sectional area of the nozzle 5 and the outlet gap 4 is maintained constant and there is precluded any deviation or deflection of one of the lip members 6 and 7. At the marginal regions of the stock suspension, flowing along the step portions 14, there is produced in each case microturbulence at the region of the end surfaces 15. This microturbulence, with appropriate sharp-edged configured free corners of the step portions 14, causes a detachment of the flow at least from the end surfaces or faces 15.

Consequently, there are advantageously produced high shear stresses at the region of the outlet gap 4, i.e. practically directly prior to the sheet formation, at the marginal or boundary region of the stock flow. These high sheer stresses produce a particularly intensive turbulence of the stock fiber suspended in the stock suspension or pulp, and thus, ensure for a substantially uniform, streak-free formation of the stock fibers.

Figure 5:
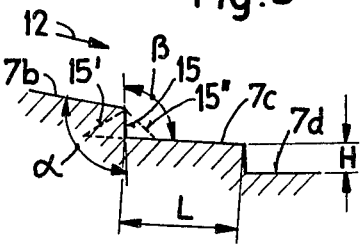
FIGS. 5, 6 and 7 illustrate details, on an enlarged scale, of the headbox constructions of FIGS. 1 2 and 3.

As will be particularly evident by referring to FIG. 5, the end surfaces or faces 15 enclose with the flow upstream neighbouring partial surfaces *7a, 7b* and *7c* a respective angle $\alpha$, and with the flow downstream neighbouring partial surfaces *7b, 7c* and *7d* a respective angle $\beta$. In the solid line position of the end surface 15 the angles $\alpha$ and $\beta$ each amount to approximately somewhat what more than 90°. In accordance with the modified phantom line shown positions of the end surfaces 15' and 15'' the angles $\alpha$ and $\beta$ each can be approximately in a range of 40° to 150°. Particularly favorable for the flow are headbox constructions having a larger number of steps or step portions than shown in the exemplary embodiment of FIG. 1, the height H of which step portions amounts to at least 2 mm, and their length L, measured in the flow direction, each amounts to at least threefold, preferably five to tenfold of the height H.

Figure 2:
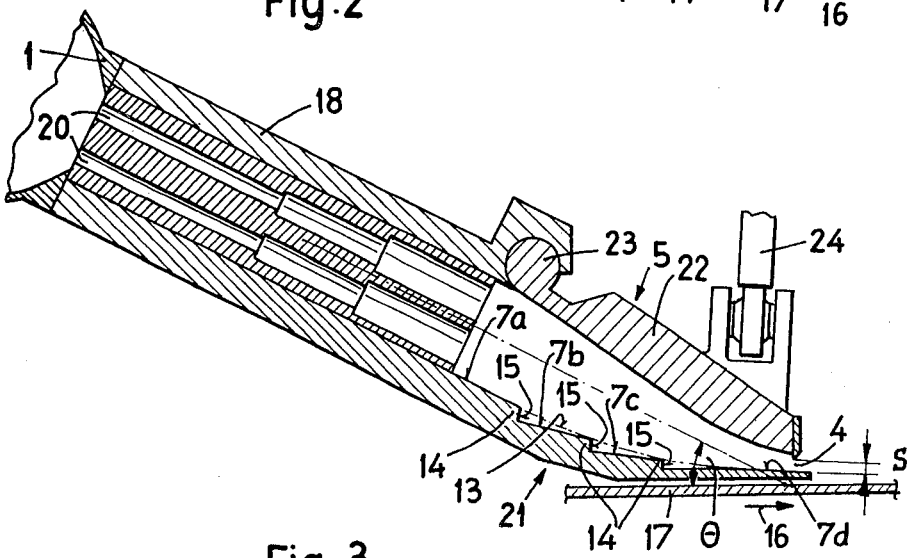
FIGS. 2, 3 and 4 respectively illustrate further embodiments of headboxes in corresponding sectional views.

As will be seen from the embodiment shown in FIG. 2 the manifold or distributor line 1 is connected with a guide device 18 which is equipped with step-like widened throughflow openings or channels 20. The lower portion of the guide device 18 transforms into a rigid lower lip or lip member 21. At the upper portion of the guide device 18 there is pivotably connected in conventional fashion a rigid upper lip or lip member 22 which bounds the nozzle channel 5. This rigid upper lip member 22 is pivotable about a cylindrical part or portion 23 which extends essentially parallel to the outlet gap or slice 4. This lip member 22 possesses a convex underside and is adjustable in relation to the lip member 21 by means of an adjustment rod or linkage 24 or equivalent adjustment element which is operatively connected with a not here particularly shown but conventional adjustment device. With this embodiment the free edges of the step portions 14, which are the inner edges in relation to the curvature, are positioned at the region of the reference lines 13. By means of the adjustment rod or linkage 24 it is possible to regulate in known manner the width S of the outlet gap 4.

Figure 3:
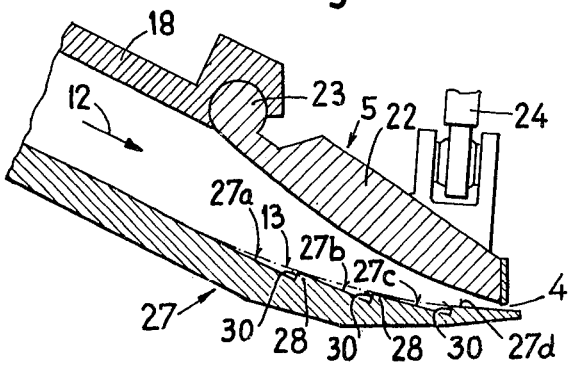

With the modified embodiment of headbox shown in FIG. 3 the guide device 18 is structured as an open connection channel which, for instance, is connected with a here not shown container or receptacle. The lower portion of the guide device 18 merges into a lip or lip member 27 which is provided at the domed or arched region of its inner surface, defined by the reference lines 13, with step portions or steps 28. Each of these steps or step portions 28 is formed by an end surface or face 30 directed opposite to the primary flow direction of the stock suspension indicated by the arrow 12 and a related partial surface **27*b*, 27*c* and 27*d* of the inner surface of the lip 27 and which corresponding partial surface merges with the related end surface 30 downstream with respect to the direction of flow. Also the partial surfaces 27*b* and 27*c* are each inclined at a smaller angle towards the partial surface 27*d* leading to the outlet gap 4 than in relation to the neighbouring flow upstream partial surfaces 27*a* and 27*b*, respectively. At the region of the step portions 28 there is produced a particularly intensive turbulence of the stock fibers which are located at the marginal flow or boundary zone of the stock suspension, with otherwise practically undisturbed course of the marginal flow, if the end surfaces 30 each are disposed at an angle of about 40° to 90° with respect to the related flow upstream partial surface 27*a*, 27*b* and 27*c***, respectively.

The previously described headbox constructions have been found to be particularly suitable for use as secondary headboxes, by means of which the layer or ply which is to be formed can be deposited in known manner upon a first layer which already is located upon the dewatering surface 17.

Figure 4:
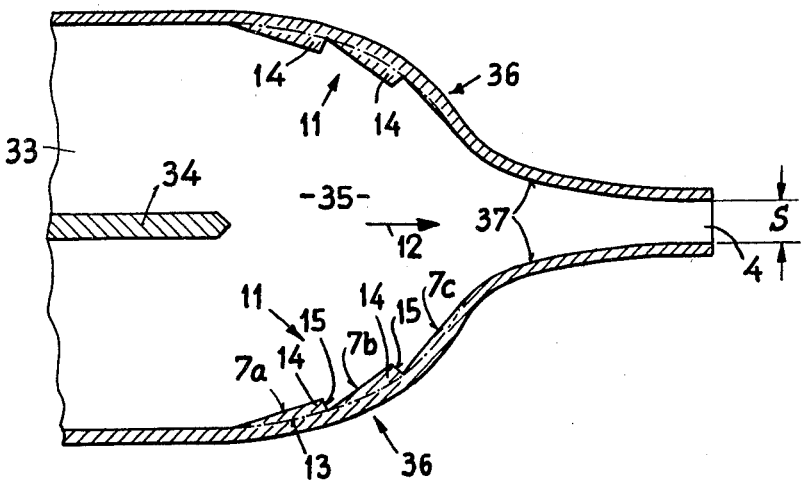

The headbox construction shown in FIG. 4 contains an infeed channel 33 for the stock suspension. This infeed channel 33 is subdivided by a partition or separation wall 34 into two essentially parallel partial channels and at which merges a nozzle channel 35 converging towards the outlet gap 4. This nozzle channel 35 is bounded by two mutually symmetrical lip members or lips 36. Each of these lip members 36 possesses a concave portion or section 11 which merges with the infeed channel 33 and a section or portion 37 which merges with the concave section 11 downstream thereof and which is convex with respect to the flow of the stock suspension. With this construction both the concave sections 11 are each formed by the flat partial surfaces **7*a*, 7*b* and 7*c* and the related end surface or face 15**.

Figure 6:
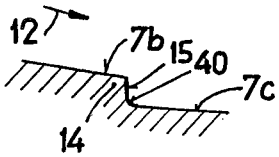
Figure 7:
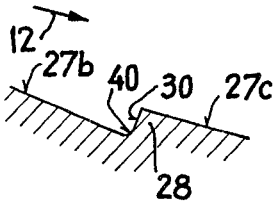

Finally, as shown in FIGS. 6 and 7 the end surfaces or faces 15 and 30 of the step portions 14 and 28, respectively, also in each case can merge by means of a groove or fillet-like corner portion 40 w1th the partial surface of the inner surface which peripherally merges thereat with respect to the curvature. Instead of such type of rounded portions there also could be provided approximately fillet weld-like fills or beads at the corresponding corners.

While there are shown and described present preferred embodiments of the invention, it is to be distinctly understood that the invention is not limited thereto, but may be otherwise variously embodied and practiced within the scope of the following claims. Accordingly,

What I claim is:

1. A headbox for a papermaking machine comprising:

a nozzle channel through which flows a stock suspension;

said nozzle channel having an outlet slice and converging in the direction of said outlet slice;

said nozzle channel being bounded by two lip members;

said two lip members extending in a primary flow direction of the stock suspension and each terminating substantially at the region of said outlet slice;

one of said lip members having a plurality of step portions at an inner surface thereof which extends substantially transversely with respect to said primary flow direction of the stock suspension;

each said step portion comprising an essentially flat partial surface of the inner surface of said lip member and an end surface disposed substantially transversely with respect to the primary flow direction of the stock suspension;

each said flat partial surface extending substantially in a lengthwise direction essentially in the primary flow direction of the stock suspension;

each said step portion being arranged at a portion of the inner surface of said lip member which is substantially concave with respect to the stock suspension;

said step portions producing turbulence at a boundary flow region of the stock suspension flowing along the step portions and at least partial detachment thereof at the region of said concave portion in order to substantially annihilate secondary flow of the stock suspension at the region of said concave portion caused by centrifugal forces effective at the stock suspension, in order to thus essentially preclude the formation of turbulence threads and thus streaking of a formed paper web;

said concave portion defining part of a flow path of the stock suspension which extends in a substantially curved configuration with respect to the primary flow direction of the stock suspension; and a corner of said step portion being located essentially at the region of the flow path of the stock suspension which extends in said curved configuration with respect to the primary flow direction of the stock suspension.

2. The headbox as defined in claim 1, further including:

means defining an infeed channel for the infeed of a stock suspension;

a guide means arranged between the infeed channel and the nozzle channel and through which flows the stock suspension from said infeed channel to said nozzle channel;

means defining a substantially band-shaped movable dewatering surface;

said guide means extending at an acute angle with respect to said band-shaped movable dewatering surface; and said step portions being arranged between said guide means for the stock suspension and a portion of the inner surface of said lip member which extends at least approximately parallel to the dewatering surface and towards the outlet slice.

3. The headbox as defined in claim 2, wherein:

each step portion has merging thereat in a flow upstream and flow downstream direction a respective substantially flat portion of the inner surface of said lip member.

4. The headbox as defined in claim 1, wherein:

each said step portion has merging thereat in a flow upstream and flow downstream direction a respective substantially flat portion of the inner surface of said lip member.

5. The headbox as define in claim 1, wherein:

each said step portion contains an end surface;

a fillet-like corner portion interconnecting the end surface of the step portion with a portion of the inner surface of said lip member which peripherally merges with said end surface.

6. The apparatus as defined in claim 1, wherein:

at least one of said lip members is structured to be movable in relation to the other lip member.

7. The apparatus as defined in claim 6, further including:

means for moving said one lip member relative to the other lip member.

* * * * *